US006435862B1

(12) United States Patent
Fioriti et al.

(10) Patent No.: US 6,435,862 B1
(45) Date of Patent: Aug. 20, 2002

(54) MODULATING FUEL GAS BURNER

(75) Inventors: Gerald A. Fioriti, Rock Tavern, NY (US); Janos Pados, New Milford, NJ (US)

(73) Assignee: Aerco International, Inc., Northvale, NJ (US)

( * ) Notice: Subject to any disclaimer, the term of this patent is extended or adjusted under 35 U.S.C. 154(b) by 0 days.

(21) Appl. No.: 09/650,953

(22) Filed: Aug. 29, 2000

(51) Int. Cl.[7] ..... F23D 14/62; F23M 9/00

(52) U.S. Cl. ..... 431/354; 431/350; 431/185; 431/182; 431/175; 239/403; 122/17.1

(58) Field of Search ..... 431/354, 350, 431/278, 185, 181, 182, 183, 168, 169, 173, 174, 175, 176, 75; 239/399, 403; 122/13.01, 17.1; 60/737, 740, 748

(56) References Cited

U.S. PATENT DOCUMENTS

| | | | | | |
|---|---|---|---|---|---|
| 1,885,067 | A | * | 10/1932 | Woodeson | 431/185 |
| 3,227,202 | A | * | 1/1966 | Morgan | 431/185 |
| 3,273,621 | A | * | 9/1966 | Childree | 431/354 |
| 3,367,384 | A | * | 2/1968 | Voorheis | 431/9 |
| 4,729,734 | A | * | 3/1988 | Polomchak et al. | 431/185 |
| 4,735,174 | A | | 4/1988 | Crump | 122/18.31 |
| 4,852,524 | A | | 8/1989 | Cohen | 122/448.1 |
| 4,884,555 | A | | 12/1989 | Huang | 431/183 |
| 5,365,887 | A | | 11/1994 | Fenn | 122/18.4 |
| 5,687,678 | A | | 11/1997 | Suchomel et al. | 122/250 R |
| 5,863,192 | A | * | 1/1999 | Motegi | 431/354 |
| 5,881,681 | A | | 3/1999 | Stuart | 122/18.31 |
| 5,975,887 | A | | 11/1999 | Kamal et al. | 435/354 |

FOREIGN PATENT DOCUMENTS

| | | | |
|---|---|---|---|
| DE | 43 30 160 A | * | 3/1995 |
| FR | 2 336 633 A | * | 8/1977 |

* cited by examiner

*Primary Examiner*—Henry Bennett
*Assistant Examiner*—Josiah C. Cocks
(74) *Attorney, Agent, or Firm*—BakerBotts, LLP

(57) ABSTRACT

A fuel gas burner is provided having a stable flame that undergoes complete combustion in a reduced length combustion region and chamber. The fuel gas burner operates over a wide modulation range with excellent stability and efficiency, and is suitable for water heating systems and other applications.

14 Claims, 5 Drawing Sheets

MODULATING FUEL GAS BURNER

BACKGROUND OF INVENTION

This invention relates to a gas-fired burner for a water heating system and, more specifically, to a burner that operates over a broad modulation range having excellent stability with a reduced length combustion region.

A major problem regarding water heating systems relates to the overall size of the installation, which depends in part on the volume of the combustion device and associated heat exchanger. A smaller installation size of the system is desirable to conserve space, as long as the system operates efficiently and with low emission of pollutants.

For thermodynamic efficiency, the water heating system may employ a modulating fuel gas burner. Efficient water heating systems may anticipate their load and respond to changes by controlling the flow of air and fuel gas to the burner. The higher the turndown ratio that can be achieved with the modulating burner, the more efficiently the water heating system can be operated. However, a high turndown ratio must be achieved with a system that also has a high maximum energy release, for example, up to and exceeding about two million BTU per hour for commercial water heating systems.

Another problem relates to the degree of carbon monoxide and other emissions. To reduce emissions, adequate mixing of air and fuel is needed. Also, some emissions tend to increase with increasing flame temperature and length. Conventional power-driven burners require a long combustion region to provide complete burning at low emissions.

To avoid the losses of efficiency and reduce emissions, water heating systems typically have a long combustion region followed by a heat exchanger. While the long combustion region provides adequate residence time for mixing and complete combustion, it also suffers radiant transfers from the flame or combusting mixture directly to the walls. Further, a long flame and combustion region increases the overall size of the water heating system dramatically. Commercial burners operating at about two million BTU per hour typically require a combustion region of at least fifty inches in length, exacerbating the problem of limited installation space.

Turndown ratios of about 4:1 or more can only be achieved with power-driven burners that utilize forced air for the combustion mixture. Such burners typically require a long combustion region for adequate mixing of fuel gas and air, complete burning, and reduced emissions.

One way to reduce the overall package size and installation size of the water heating system without sacrificing efficiency is to employ a counterflow design of the water in the heat exchanger relative to the flue gas. For example, U.S. Pat. No. 5,365,887 describes a counterflow water heating system that reduces the overall package size by reducing the heat exchanger size. In another example, U.S. Pat. No. 4,735,174 describes a counterflow water heating system that increases efficiency of heat exchange. In another example, a condensing mode counterflow water heating system is described in U.S. Pat. No. 5,687,678 which employs nested heat exchanger coils.

Another important means to reduce overall size of the water heating system and improve efficiency is to reduce the length of the combustion region and chamber. A smaller combustion region requires that the length of the flame or combusting mixture be reduced, while still allowing efficient heat exchange and complete combustion. For example, U.S. Pat. No. 4,884,555 describes a detached flame swirl burner for a water heater having a short, turbulent flame. However, the combustion region is well above the burner assembly, adding length to the system.

In further examples, gas-fired nozzle mix burners for a water heating system are described in U.S. Pat. Nos. 4,852,524 and 5,881,681. However, these systems operate with a long flame and combustion region. Complete combustion in these systems typically requires a combustion region length of at least fifty inches.

In order to reduce the length of the combustion region and provide a physically compact gas-fired burner and combustion region, one of the features needed is premixing of the air and fuel gas before entering the burner, or within the burner itself. For example, U.S. Pat. No. 5,975,887 describes a compact gas-fired burner having a premixing tube disposed within the burner and a fuel gas tube extending into the premixing tube.

Accordingly, there is a need to provide a power-driven gas-fired burner that provides a stable flame and complete combustion in a reduced length combustion region to reduce the overall size requirement of a water heating system in which it is employed. Such a burner should operate efficiently and reduce radiant transfer of energy from the flame directly to the walls.

SUMMARY OF THE INVENTION

This invention solves the deficiencies described in the previous section and provides a fuel gas burner having a short, stable flame to be used with a reduced length combustion region and chamber. The fuel gas burner of this invention can be used, for example, in a condensing, fully modulating, forced draft, vertical single-pass, fire-tube water heating system that operates over a broad modulation range with excellent stability, reliability and cost-efficiency.

These objectives and characteristics are achieved, in accordance with the present invention, by providing a novel combination of several components in one embodiment to form a compact fuel gas burner that produces a short, attached flame in an adjacent combustion region, the fuel gas burner having a recessed head, fuel gas channel design, multiple pathways for air and fuel gas to provide mixing, rotation of the combusting air-fuel gas mixture, and partial premixing of air and fuel in the burner head.

The fuel gas burner of this invention has a fuel gas pipe attached to a burner head. The burner head comprises a bottom plate concentrically attached to a middle plate, in which the bottom plate and middle plates define an opening at the center to receive fuel gas from the fuel gas pipe. The bottom plate and adjacent middle plate together define an annular cavity that is open at the center for receiving fuel gas from the fuel gas pipe and is closed at the outer edge of the middle plate. The outer edge of the middle plate and the adjacent portion of the bottom plate define a plurality of fuel gas channels extending radially outward. The bottom and middle plates further define at least two annularly spaced-apart holes for passage of air directly through the bottom and middle plates into the combustion region. The bottom plate also defines at least two annularly spaced-apart holes for passage of air into the annular cavity to mix with fuel gas in the cavity. A corresponding set of matching holes is provided in the middle plate to allow the partially premixed air and fuel gas to flow out to the burner head surface. The bottom plate and middle plate also have openings for inserting a flame detector and an igniter into the combustion region. The burner head further comprises a gas cap concentrically attached to the middle plate for closing the second end of the fuel gas pipe. The gas cap has at least two annularly spaced-apart holes for passage of fuel gas directly to the combustion region. The burner head also comprises annularly spaced-apart spinner vanes attached to the bottom plate extending away from the bottom plate toward the combustion region in asymmetric relation to the fuel gas channels.

The burner head resides in a shell comprising an annular baffle concentrically attached to a cylindrical side wall, the shell defining a shell chamber within which the burner head resides. The annular baffle has an opening through which the fuel gas pipe passes and an opening for entry of air into the shell chamber. The burner head and the cylindrical side wall define an annular opening for passage of air from the shell chamber around the burner head to the combustion region.

The shell and annular baffle are covered by a housing which attaches to and supports the shell. The housing defines an opening through which the fuel gas pipe enters the shell chamber and a spiraling air duct through which air enters the shell chamber. Openings are provided in the housing and annular baffle for the igniter and the flame detector.

The fuel gas burner of this invention provides stable and complete combustion of fuel gas within a distance of less than about twenty-four inches from the fuel gas burner head at energy release rates of up to and exceeding two million BTU per hour.

In another embodiment, this invention is an improved water heating system comprising a fuel gas burner as described, a combustion chamber for receiving the heated gas and combustion products of the fuel gas burner, a heat exchanger adjacent to the combustion chamber for providing heat transfer between the heated gas and combustion products of the fuel gas burner and a second fluid, and a temperature controller using at least one temperature sensor and at least one air/fuel valve.

In another embodiment, this invention is a method of heating water by providing a fuel gas burner according to this invention, installing the fuel gas burner in a water heating system, and operating the system to transfer heat to the water.

For a better understanding of the present invention and its objects, reference is made to the following drawings and description to be considered in light of the complete application, and the scope of this invention as pointed out in the appended claims.

DETAILED DESCRIPTION

The fuel gas burner of this invention provides stable, complete combustion of a mixture of air and fuel gas within a region less than about twenty-four inches from the burner head at energy release rates of up to and greater than about 2,000,000 BTU per hour, which represents about 2,000 cubic feet per hour of natural gas. The burner is capable of partial premixing of the air and fuel gas to provide complete high quality combustion over a wide range of turndown ratio, preferably greater than 4:1, more preferably greater than 10:1, even more preferably greater than 18:1, and most preferably eater than 20:1, resulting in high combustion efficiency and very low pollutant emissions.

Figure 1A:
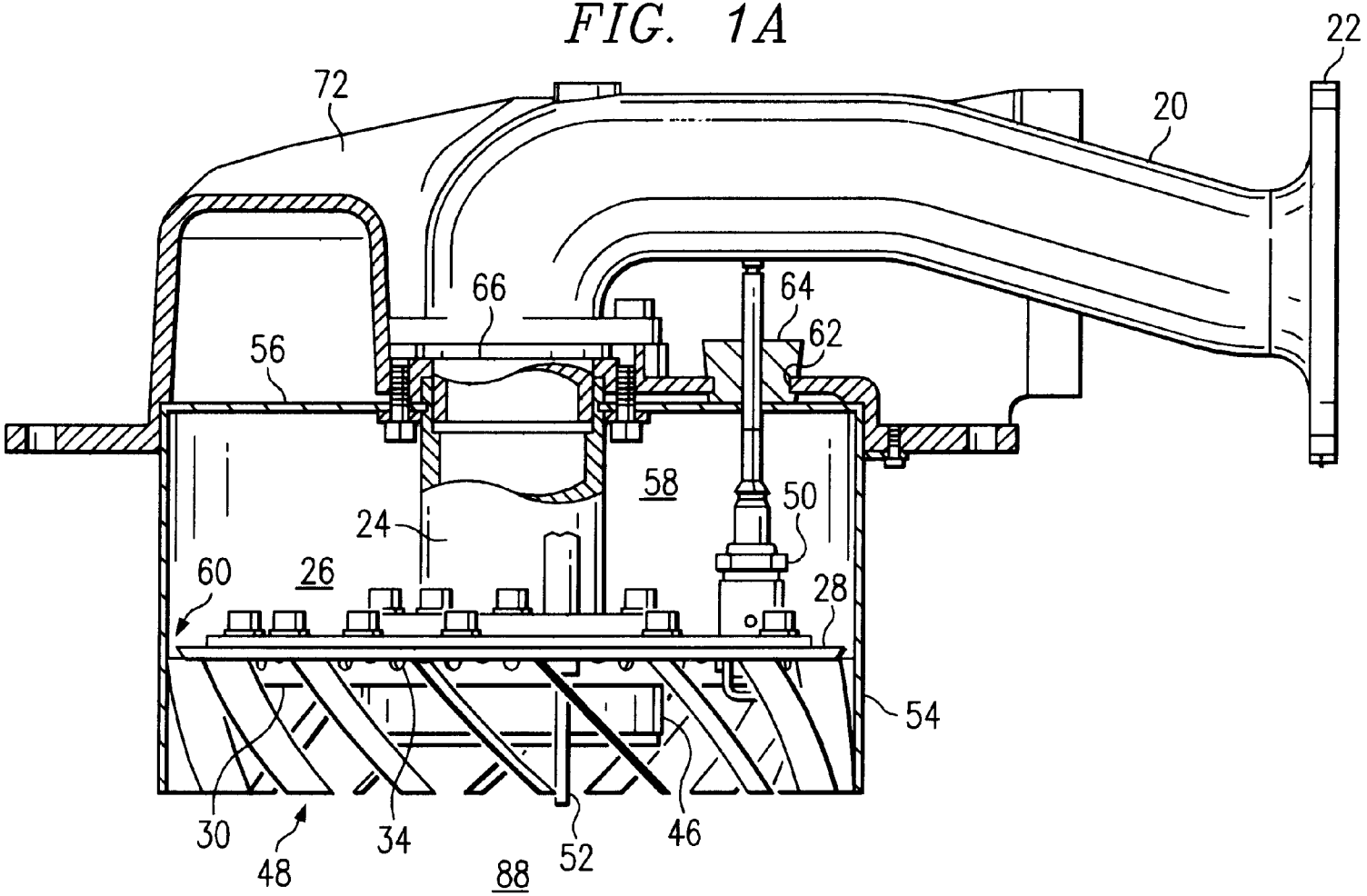
FIG. 1A is an elevation view of an embodiment of a fuel gas burner of this invention.

An embodiment of the fuel gas burner of this invention is shown in FIGS. 1–3. Referring to FIG. 1A, the fuel gas pipe 20 is open at its first end 22 to receive fuel gas. At the second end 24 of the fuel gas pipe, the burner head 26 is attached. The burner head efficiently ignites a combustible mixture of air and gas to provide the hot gases that may be used, for example, to heat water.

Figure 1B:
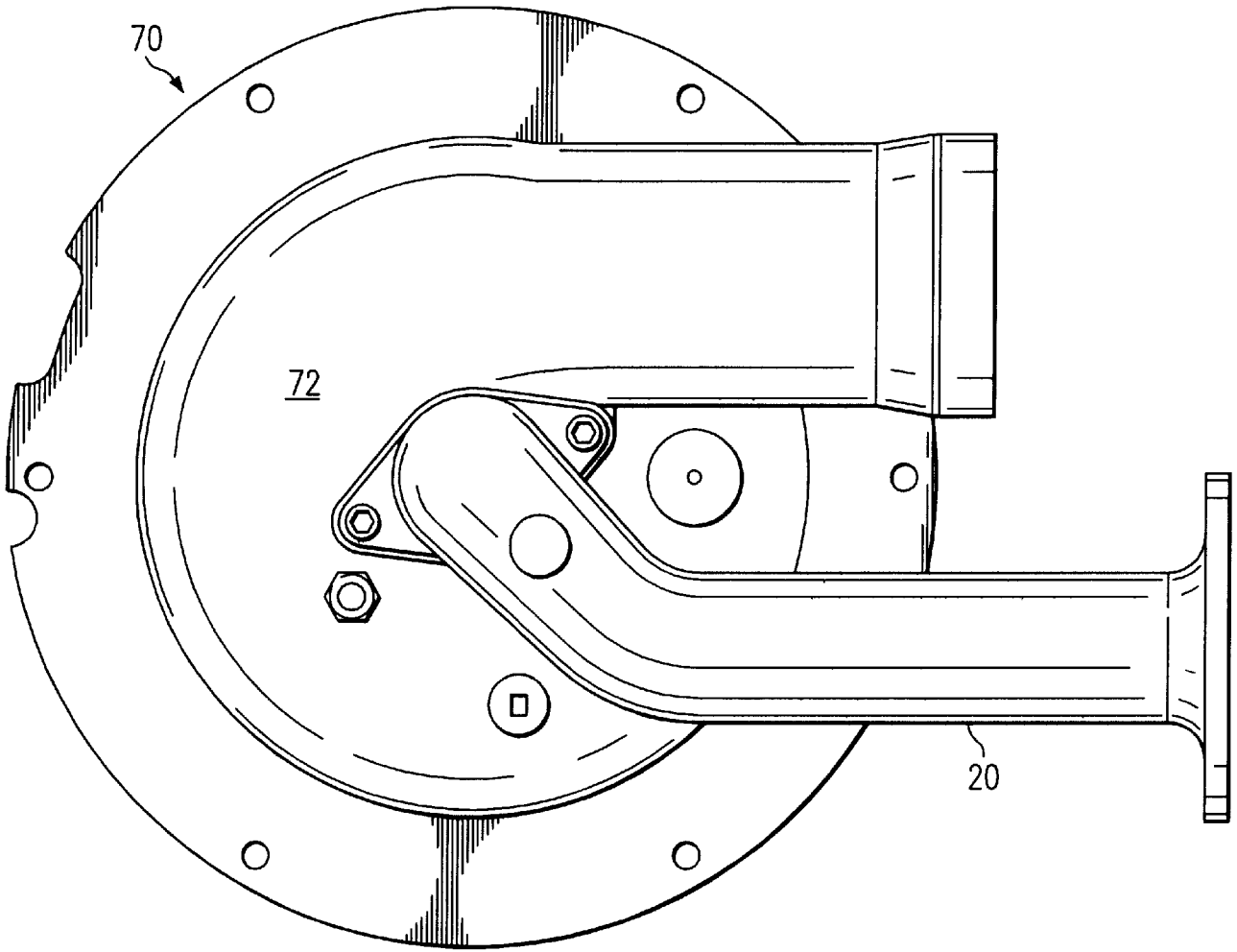
FIG. 1B is a top plan view of an embodiment of a fuel gas burner of this invention.

Referring to FIGS. 1A and 1B, the fuel gas pipe 20 and attached burner head 26 are supported by a housing 70 which attaches to the fuel gas pipe. The burner head is recessed within a shell formed by an annular baffle 56 that is concentrically attached to the shell cylindrical side wall 54. The shell is supported by the housing 70 which attaches to the shell and covers the shell and annular baffle 56. The shell defines a chamber 58 within which the burner head resides. The recessed burner head 26 does not extend beyond the shell cylindrical side wall 54. The annular baffle 56 has an opening 66 through which the fuel gas pipe enters and an opening for entry of air into the shell chamber 58 from the spiraling air duct 72. The burner head 26 and the shell cylindrical side wall 54 define an annular opening 60 for passage of air around the burner head. The housing defines a spiraling air duct 72 through which air enters the shell chamber 58. The fuel gas pipe attaches to the housing and passes through an opening 66 in the housing to enter the shell chamber 58.

The combustion region 88 begins at the surface of the middle plate and extends away from the middle plate into adjacent space outside the cylindrical side wall 54, as shown in FIG. 1A.

Figure 1C:
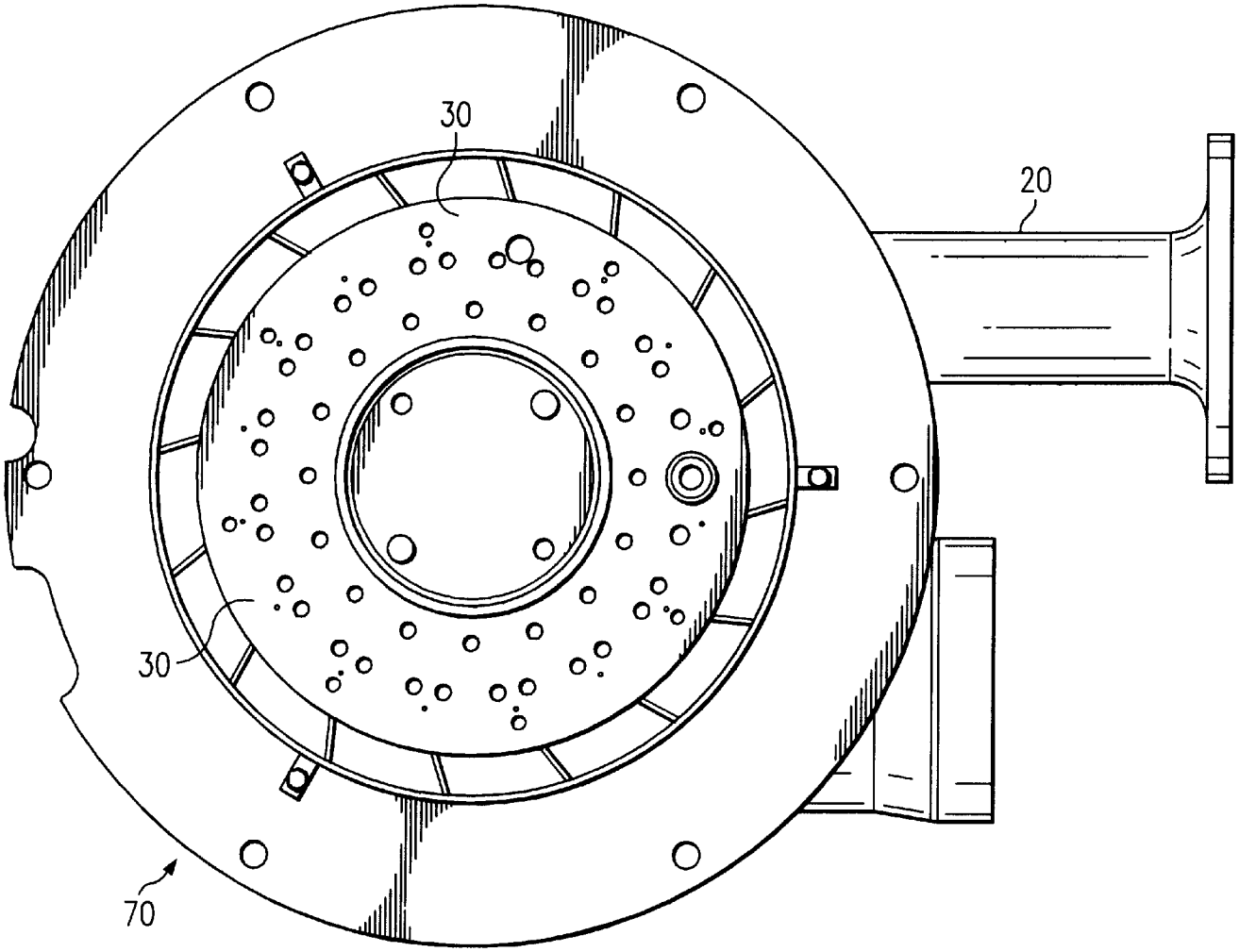
FIG. 1C is a partial bottom plan view of an embodiment of a fuel gas burner of this invention.

The burner head comprises a bottom plate 28 which is concentrically attached to a middle plate 30, as shown in FIG. 1A. The middle plate 30 is also illustrated in FIGS. 1C, 3A, and 3B. Referring to FIGS. 3A and 3B, the bottom plate and the middle plate 30 each have an opening 32 at the center to receive fuel gas from the fuel gas pipe. The bottom plate and middle plate further define an annular cavity 38 that is open at the center for receiving fuel gas from the fuel gas pipe. The annular cavity 38 is closed by the bottom plate and middle plate at the outer edge 31 of the middle plate 30 at which point the two plates are contiguous in an annular ring. The outer edge 31 of the middle plate and the adjacent portion of the bottom plate define a plurality of fuel gas channels 34 extending radially outward. In the embodiment shown in FIGS. 1–3, the pattern of holes and openings in the bottom plate and the middle plate are the same, and are illustrated for the middle plate in FIG. 3A. Referring to FIG. 3A, the bottom plate and the middle plate also define two series of annularly spaced-apart holes 36. These holes 36 are located within raised portions 40, or bosses, of the middle plate. The bosses extend contiguously from the middle plate to the bottom plate, and thus are located within the annular cavity 38 between the bottom and middle plates. Thus, holes 36 allow passage of air directly through the bottom and middle plates and into the combustion region 88 without mixing with fuel gas in the annular cavity 38.

The fuel gas burner of this invention provides partial premixing of fuel gas and air. In the embodiment shown in FIG. 3A, a series of annularly spaced-apart calibrated holes 42 are provided in the middle plate. A series of corresponding holes is provided in the bottom plate which allow the passage of air from the shell chamber 58 into the annular cavity 38 to mix with fuel gas in the annular cavity. The corresponding calibrated holes 42 in the middle plate further allow for passage of a portion of the premixed fuel gas and air to pass through the middle plate into the combustion region 88.

The bottom and middle plates further define openings for inserting a flame detector 52 and an igniter 50 into the combustion region 88. The location of these openings is also illustrated in the embodiment shown in FIG. 3A, as opening 74 for the igniter 50, and as opening 76 for the flame detector 52.

Figure 2A:
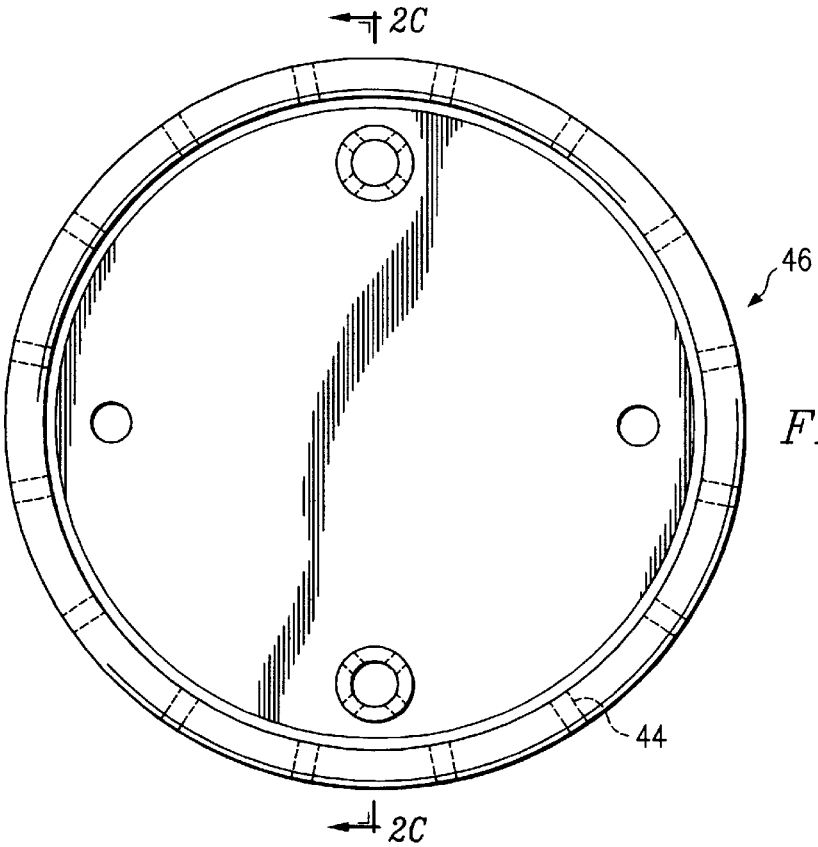
FIG. 2A is a top plan view of an embodiment of a fuel gas burner gas cap of this invention.
Figure 2B:
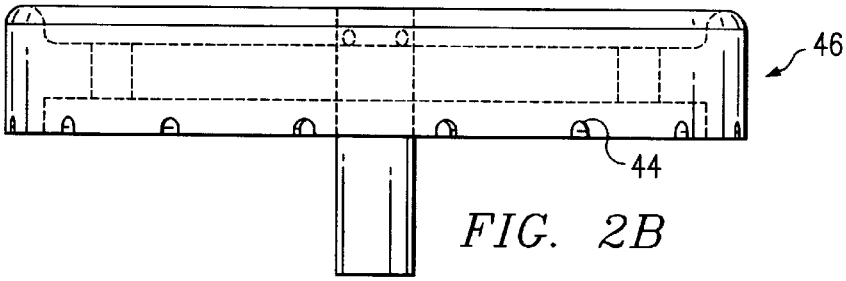
FIG. 2B is an elevation view of an embodiment of a fuel gas burner gas cap of this invention.
Figure 2C:
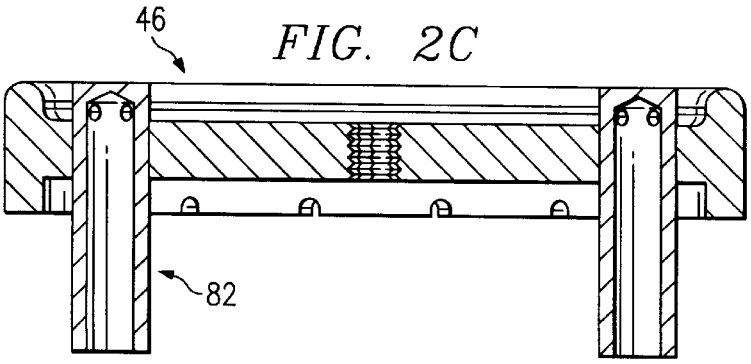
FIG. 2C is an elevation view of an embodiment of a fuel gas burner gas cap of this invention.
Figure 2D:
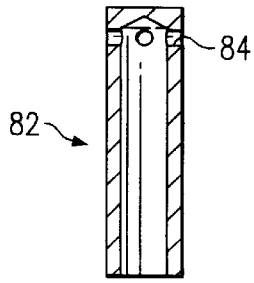
FIG. 2D is an elevation view of an embodiment of a fuel gas burner gas cap capsule of this invention.
Figure 3A:
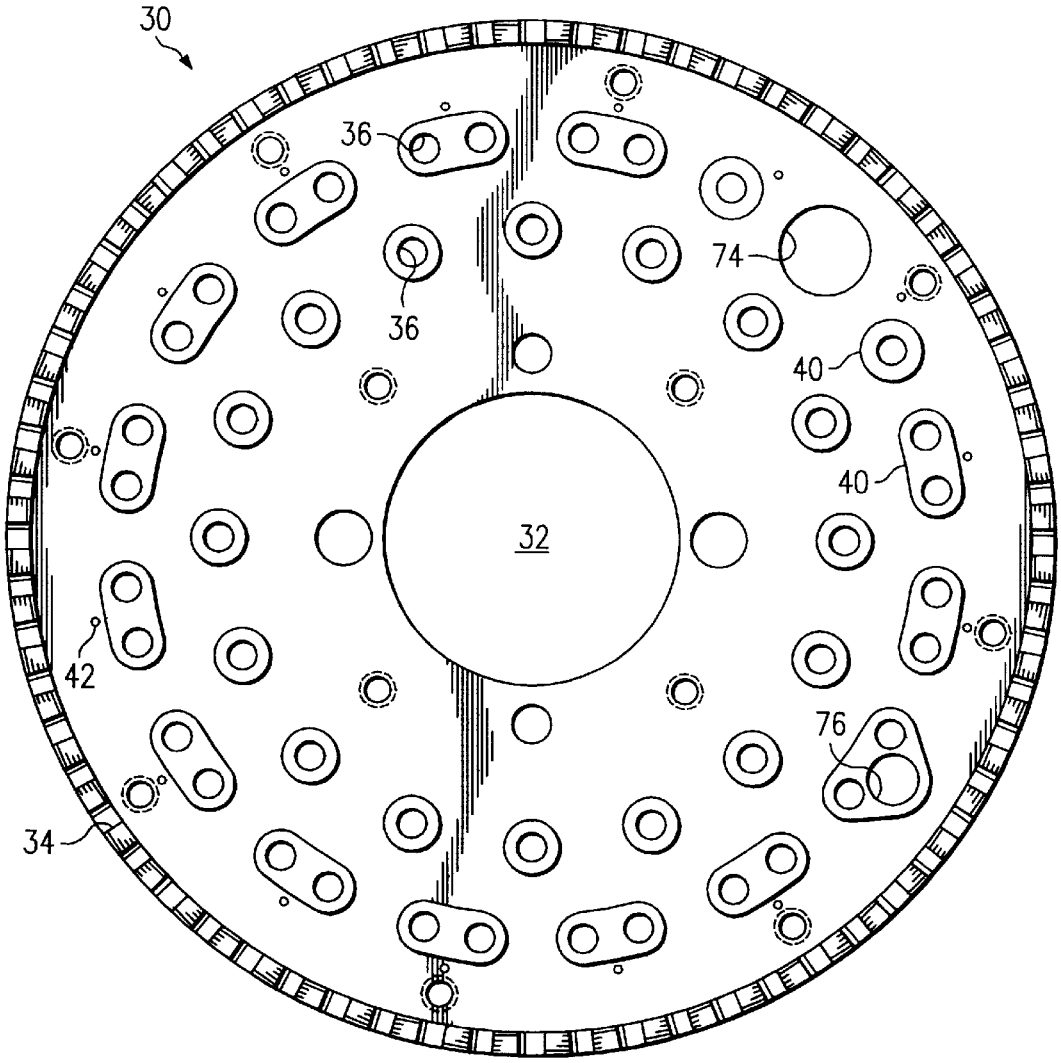
FIG. 3A is a top plan view of an embodiment of a middle plate of a fuel gas burner head of this invention.
Figure 3B:
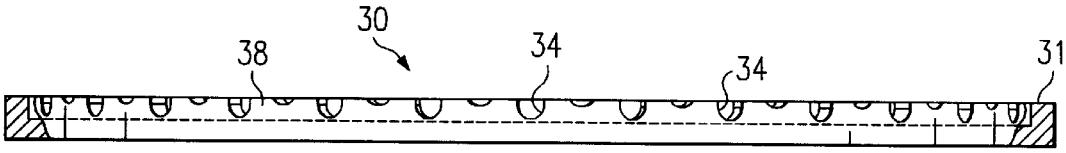
FIG. 3B is an elevation view of an embodiment of a middle plate of a fuel gas burner head of this invention.

Referring to FIGS. 2A and 2B, a gas cap 46 is provided in the burner head which is concentrically attached to the middle plate 30 and closes the second end 24 of the fuel gas pipe. The gas cap defines annularly spaced-apart holes 44 for passage of fuel gas from the fuel gas pipe directly to the combustion region 88. As shown in FIGS. 2C and 2D, the gas cap may optionally be fabricated with capsules 82 having fuel gas exit holes 84 to allow passage of fuel gas directly to the outer surface of the gas cap to improve flame attachment.

Referring to FIG. 1A, the burner head further comprises annularly spaced-apart spinner vanes 48 attached to the bottom plate extending away from the bottom plate toward the combustion region 88 in asymmetric relation to the fuel gas channels 34. The annular opening 60 provides a second path for air to flow through the burner, the first path being through the calibrated holes 42 in the bottom plate and middle plate of the burner head. The annular baffle 56 and housing 70 further define an opening 62 for the igniter 50, in which the igniter is seated in place by a plug 64, and an opening 68 for the flame detector 52.

Various features of the fuel gas burner of this invention provide stable flame and combustion over a wide range of energy input and release rates. First, the air-fuel gas mixture exits the fuel gas channels 34 perpendicularly to the flow of the air which has passed through the annular opening 60 and around the burner head. Thus, these two flows of an air-fuel gas mixture collide at approximately a right angle, providing additional mixing to enhance combustion. Second, the burner head 26 is recessed within the shell cylindrical side wall 54 to reduce radiant transfer and improve flame attachment. Third, the rotation of the air-fuel gas mixture provided by the spinner vanes 48 reduces burning delays and combustion oscillations. The asymmetrical relation of the spinner vanes 48 to the fuel gas channels 34 causes the combusting mixture to rotatably mix. This prevents combustion driven oscillation and other instabilities, thereby reducing burning delay and increasing the stability of the system. The spinner vanes define an acute angle with respect to the plane of the bottom plate, when viewed in projection from the side. Lastly, partial premixing of air and fuel gas in the annular cavity 38 speeds combustion as the air-fuel gas mixture flows through the combustion region 88. The combination of all these features, as illustrated in the embodiment shown in FIGS. 1–3, produces stable, complete burning over a wide modulation ratio without combustion driven oscillation or flame detachment.

Operation of the embodiment of the fuel gas burner of this invention shown in FIGS. 1–3 will now be described. Air and fuel gas from an external air/fuel valve separately enter the housing 70 and the first end of the fuel gas pipe 22, respectively. The air flows along a centrifugal path through the spiraling air duct 72 and passes through the annular baffle 56 to enter the shell chamber 58. Air then flows by one of four pathways: (1) into the annular cavity 38 via calibrated holes 42 in the bottom plate, and then through the fuel gas channels 34, (2) into the annular cavity 38 via calibrated holes 42 in the bottom plate, and then through calibrated holes 42 in the middle plate, (3) through the series of holes 36 in the bottom and middle plates directly into the combustion region 88, or (4) through the annular opening 60 passing around the burner head 26. Fuel gas flows through the fuel gas pipe 20 and into the annular cavity 38 between the bottom plate 28 and the middle plate 30. In the annular cavity 38 fuel gas premixes with air and flows either through the series of holes 42 directly into the combustion region 88 or through the fuel gas channels 34. A third path for fuel gas is to flow through the holes 44 in the gas cap 46, and an optional fourth path is to flow through the holes 84 in the gas capsules 82 directly to the surface of the burner head. The use of optional gas capsules 82 to bring fuel gas to the surface of the gas cap increases flame attachment.

The air entering the annular cavity 38 through the calibrated holes 42 in the bottom plate 28 mixes with fuel gas to provide partial premixing of air and fuel. Air passing through the annular opening 60 and around the burner head collides with the air-fuel gas mixture exiting the fuel gas channels 34 at approximately a right angle. The two flows of gases combine into a mixture which is spun at high velocity by the spinner vanes 48. The combined air-fuel gas mixture is ignited in the combustion region 88 by the igniter 50, and the combusting mixture flows out of the shell cylindrical side wall 54 into an adjacent extended combustion region 88.

The shell cylindrical side wall 54 may be cast aluminum. Optionally, a stainless steel band may be located on the inside of the shell cylindrical side wall 54 in the area of the annular opening 60 to prevent fouling. The burner head components and spinner vanes may also be made from stainless steel, or other suitable materials as known to those of skill in the art.

The air and fuel gas flow to the burner may be controlled by an air/fuel valve, which provides separate and proportional air and fuel gas flows to the burner. Such an air/fuel valve may provide for a linear response to a control signal from a temperature controller. The flows of air and fuel gas to the burner may be maintained at a constant ratio to produce an air-fuel gas mixture in the burner having excess oxygen of about five percent.

A water heating system employing a fuel gas burner according to this invention may include a heat exchanger, a temperature controller with one or more temperature sensors, one or more air/fuel valves, and a combustion chamber. For example, a water heating system that may employ the fuel gas burner of this invention is described in U.S. Pat. No. 5,881,681.

The ability of the fuel gas burner of this invention to be modulated over a wide range of energy release rates is advantageous to the overall efficiency of its operation. Efficient water heating systems will anticipate load and respond to changes by controlling the flow of air and fuel gas to the burner. The higher the turndown ratio that can be achieved with the modulating burner, the more efficiently the water heating system can be operated because thermodynamic losses are minimized. For example, tests were performed with the embodiment of the fuel gas burner of this invention illustrated in FIGS. 1–3, and the results are shown in Table 1.

TABLE 1

Combustion characteristics of a fuel gas burner embodiment.

| TEST | VALVE POSITION % | $O_2$ % | CO ppm | $CO_2$ % | GAS PRESSURE (in./wc) | BTU/HR* × $10^6$ | TURNDOWN RATIO** |
|---|---|---|---|---|---|---|---|
| A | 100 | 5.3 | 17 | 8.9 | 7 | 2.053 | 1.0:1 |
| B | 100 | 5.5 | 24 | 8.8 | 7 | 2.020 | 1.0:1 |
| A | 40 | 7.2 | 0 | 7.8 | 9 | 0.442 | 4.6:1 |
| B | 40 | 6.8 | 0 | 8.1 | 9 | 0.431 | 4.8:1 |
| A | 25 | 8.7 | 29 | 7 | 9.4 | 0.179 | 11.5:1 |
| B | 25 | 8.7 | 0 | 7 | 9.5 | 0.159 | 12.9:1 |
| A | 20 | 11.4 | 22 | 5.5 | 9.7 | 0.099 | 20.7:1 |
| B | 20 | 9.8 | 7 | 6.4 | 9.6 | 0.114 | 18.0:1 |

*Energy release rate.
**Turndown ratio is based on energy release rate with respect to the maximum, TEST A at 100%.

As illustrated in Table 1, clean burning with low carbon monoxide output was achieved with a stable flame over a range of turndown ratios of from 1.0:1 to greater than 20:1, with a maximum energy release rate of over two million BTU per hour.

Another advantage of the fuel gas burner of this invention is to improve overall efficiency by reducing fouling due to corrosion in the heat exchanger. Since the fuel gas burner of this invention can be modulated over a broad range, the onset of condensation in the heat exchanger of the water heating system will occur at varying positions along the length of the heat exchanger. Thus, any corrosion that occurs will be distributed over the length of the heat exchanger instead of accumulating in one area. Also, when the burner is placed above the combustion region and chamber, as in a down-draft installation, this invention avoids condensation in the burner itself.

The fuel gas burner of this invention has a wide range of uses. For example, it will be readily obvious that the present invention can be used in hydronic boiler systems, low temperature water source heat pump systems, or any closed hot water system. In addition, this invention may be used by itself or in combination with other heat exchangers to provide domestic hot water. Alternatively, this invention may be used in heating systems to supply space heating energy on a priority basis.

The description of the invention as given above is meant to be illustrative, rather than to limit the invention. While there have been described embodiments of this invention, those skilled in the art will recognize that they may be changed or modified without departing from the spirit and scope of this invention, and it is intended to claim all such changes and modifications that fall within the true scope of the invention as set forth in the appended claims. All documents referenced herein are specifically incorporated by reference in their entirety.

The invention claimed is:

1. A fuel gas burner having a burner head, comprising:

means for supplying fuel gas to the burner head;

means for delivering air undergoing a spiraling motion to the burner head;

means for partial premixing of the fuel gas and the air at the burner head;

a plurality of gas channels to deliver at least a portion of the partially premixed fuel gas/air radially outward from the burner head;

multiple pathways for the fuel gas and the air and the partially premixed fuel gas/air to exit the burner head, thereby forming a combustion mixture;

means for causing rapid rotation of the combustion mixture;

wherein the fuel gas undergoes complete combustion within a distance of less than about twenty-four inches from the burner head at an energy release rate equal to or greater than two million BTU per hour.

2. The fuel gas burner of claim 1, further comprising an igniter means and a flame detector means.

3. The fuel gas burner of claim 1, wherein the fuel gas undergoes complete combustion within a distance of less than about twenty-four inches from the burner head at an energy release rate equal to or greater than one million BTU per hour.

4. The fuel gas burner of claim 1, wherein the fuel gas burner is further capable of stable combustion at a turndown ratio of greater than 4:1.

5. The fuel gas burner of claim 1, wherein the fuel gas burner is further capable of stable combustion at a turndown ratio of greater than 10:1.

6. The fuel gas burner of claim 1, wherein the fuel gas burner is further capable of stable combustion at a turndown ratio of greater than 18:1.

7. The fuel gas burner of claim 1, wherein the fuel gas burner is further capable of stable combustion at a turndown ratio of greater than 20:1.

8. A fuel gas burner, comprising:

a fuel gas pipe having first and second ends, in which the fuel gas pipe is open at its first end to receive fuel gas, wherein the second end is attached to a burner head;

a burner head comprising a bottom plate concentrically attached to a middle plate, wherein the bottom plate and middle plates define an opening at the center to receive fuel gas from the fuel gas pipe, in which the bottom plate and middle plates further define an annular cavity that is open at the center for receiving fuel gas from the fuel gas pipe and is closed by the bottom and middle plates at the outer edge of the middle plate, wherein the outer edge of the middle plate and the adjacent portion of the bottom plate define a plurality of fuel gas channels extending radially outward; the bottom and middle plates further defining at least two annularly spaced-apart holes for passage of air directly through the bottom and middle plates to the combustion region; the bottom plate further defining at least two annularly spaced-apart holes for passage of air into the annular cavity to mix with fuel gas in the cavity, the bottom and middle plates further defining holes for inserting a flame detector and an igniter into the combustion region; the burner head further comprising a gas cap concentrically attached to the middle plate for closing the second end of the fuel gas pipe, the gas cap defining at least two annularly spaced-apart holes for passage of fuel gas directly to the combustion region, the burner head further comprising annularly spaced-apart spinner vanes attached to the bottom plate extending away from the bottom plate toward the combustion region in asymmetric relation to the fuel gas channels; the burner head further comprising an igniter and a flame detector;

a shell comprising an annular baffle concentrically attached to a cylindrical side wall, wherein the shell defines a chamber within which the burner head resides, the annular baffle having an opening through which the fuel gas pipe passes and an opening for passage of air into the chamber, the burner head and the cylindrical side wall defining an annular opening for exit of air from the chamber around the burner head to the combustion region; and a housing which attaches to the shell, the housing defining an opening through which the fuel gas pipe enters the chamber, the housing further defining a spiraling air duct through which air enters the chamber, in which the housing covers the shell and annular baffle, and in which the housing and annular baffle further define openings for the igniter and the flame detector.

9. The fuel gas burner of claim 8, in which the spinner vanes define an acute angle with respect to the plane of the middle plate and cause the combustion mixture of air and fuel gas to rotate in the shell and in the combustion region.

10. The fuel gas burner of claim 8, in which the fuel gas undergoes complete combustion within a distance of less than about twenty-four inches from the fuel gas burner head at an energy release rate of greater than about two million BTU per hour, wherein the combustion region is contiguous with the burner shell.

11. The fuel gas burner of claim 8, in which the fuel gas undergoes complete combustion within a distance of less than about twenty-four inches from the fuel gas burner head at an energy release rate of greater than about 400,000 BTU per hour, wherein the combustion region is contiguous with the burner shell.

12. The fuel gas burner of claim 8, in which the fuel gas undergoes complete combustion within a distance of less than about twenty-four inches from the fuel gas burner head at an energy release rate of greater than about 100,000 BTU per hour, wherein the combustion region is contiguous with the burner shell.

13. In a water heating system having a combustion region for receiving the heated gas and combustion products of a fuel gas burner, further having a heat exchanger for providing heat transfer between the heated gas and combustion products of the fuel gas burner and a second fluid, and further having a temperature controller using at least one temperature sensor and at least one air-fuel valve, the improvement comprising:

a fuel gas burner having a burner head, comprising:

means for supplying fuel gas to the burner head;

means for delivering air undergoing a spiraling motion to the burner head;

means for partial premixing of the fuel gas and the air at the burner head;

a plurality of gas channels to deliver at least a portion of the partially premixed fuel gas/air radially outward from the burner head;

multiple pathways for the fuel gas and the air and the partially premixed fuel gas/air to exit the burner head, thereby forming a combustion mixture;

means for causing rapid rotation of the combustion mixture;

wherein the fuel gas undergoes complete combustion within a distance of less than about twenty-four inches from the burner head at an energy release rate equal to or greater than two million BTU per hour.

14. A method of heating water, comprising:

(a) providing a fuel gas burner having a burner head, comprising:

means for supplying fuel gas to the burner head;

means for delivering air undergoing a spiraling motion to the burner head;

means for partial premixing of the fuel gas and the air at the burner head;

a plurality of gas channels to deliver at least a portion of the partially premixed fuel gas/air radially outward from the burner head;

multiple pathways for the fuel gas and the air and the partially premixed fuel gas/air to exit the burner head, thereby forming a combustion mixture;

means for causing rapid rotation of the combustion mixture;

wherein the fuel gas undergoes complete combustion within a distance of less than about twenty-four inches from the burner head at an energy release rate equal to or greater than two million BTU per hour;

(b) installing the fuel gas burner in a water heating system; and (c) operating the water heating system with the fuel gas burner.

* * * * *